US005384989A

United States Patent [19]

Shibano

[11] Patent Number: 5,384,989

[45] Date of Patent: Jan. 31, 1995

[54] METHOD OF ULTRASONICALLY GRINDING WORKPIECE

[76] Inventor: Yoshihide Shibano, 1629-1-12, Oyama-cho, Machida-shi, Tokyo, Japan

[21] Appl. No.: 44,609

[22] Filed: Apr. 12, 1993

[51] Int. Cl.[6] ..... B24B 31/06

[52] U.S. Cl. ..... 451/36; 451/104

[58] Field of Search ..... 51/317, 59 SS, 356, 51/7, 17, 322

[56] References Cited

U.S. PATENT DOCUMENTS 2,591,083 4/1952 Maier ..... 51/317

3,523,834 8/1970 Hewins ..... 51/317

FOREIGN PATENT DOCUMENTS 0789293 1/1958 United Kingdom ..... 51/317

*Primary Examiner*—Robert A. Rose

*Attorney, Agent, or Firm*—Paul A. Guss

[57] ABSTRACT

A workpiece to be ground is immersed in a processing solution with abrasive grains suspended therein. The processing solution is contained in an ultrasonic processing tank equipped with an ultrasonic vibrator. Ultrasonic energy is radiated from said ultrasonic vibrator into said processing solution to ground surfaces of the workpiece. The processing solution is drawn from the ultrasonic processing tank, cooled to a temperature lower than a boiling point thereof, deaerated, and then returned to the ultrasonic processing tank.

10 Claims, 6 Drawing Sheets

METHOD OF ULTRASONICALLY GRINDING WORKPIECE

BACKGROUND OF THE INVENTION

1. Field of the Invention

The present invention relates to a method of ultrasonically grinding surfaces of a workpiece immersed in a liquid by radiating ultrasonic energy from an ultrasonic vibrator into the liquid.

2. Description of the Prior Art

Die-cast products such as machine parts have burrs, surface irregularities, and small scratches on their surfaces immediately after they are die-cast. The die-cast products are finalized when these surface imperfections are ground off.

Japanese laid-open patent publication No. 55-90261 discloses a method of finishing a workpiece by removing burrs having a height of about 100 μm from its surfaces or smoothing out relatively large surface irregularities. According to the disclosed method, the workpiece is immersed in a processing liquid containing abrasive grains, and ultrasonic energy is applied to the processing liquid. More specifically, the processing liquid is supplied to a processing tank or chamber equipped with an ultrasonic vibrator, and ultrasonic energy is radiated from the ultrasonic vibrator into the processing liquid in the processing tank to develop cavitation in the processing liquid. The abrasive grains are brought into violent collision with the workpiece surfaces by shock waves that are generated when the cavitation collapses in the processing liquid, thereby grinding the workpiece surfaces.

However, as it has turned out, the disclosed method fails to develop sufficient cavitation when ultrasonic energy is radiated into the processing liquid, and hence the workpiece surfaces cannot fully be ground by the abrasive grains.

Another known method of smoothing out or removing small surface irregularities or scratches from workpiece surfaces is an electrolytic grinding process. According to the electrolytic grinding process, a workpiece such as a metal or semiconductor component and an electrode are immersed as an anode and a cathode, respectively, in an electrolytic solution which may be a mixture of concentrated phosphoric acid and sulfuric acid, and a voltage is applied between the anode and the cathode to carry out electrolysis. The surfaces of the workpiece are dissolved by the electrolysis, smoothing out small surface irregularities or scratches having a height or depth ranging from 0.1 to several μm, so that the surfaces are made glossy. However, oxygen produced when the workpiece surfaces are dissolved is applied as bubbles to the workpiece surfaces and covers the workpiece surfaces. As the electrolysis progresses, the oxygen bubbles cover the workpiece surfaces so much that they prevent the workpiece from contacting the electrolytic solution. Then, the electrolysis fails to go on, and the workpiece surfaces are no longer smoothed.

SUMMARY OF THE INVENTION

It is therefore an object of the present invention to provide a method of ultrasonically grinding a workpiece highly efficiently.

The inventor has studied methods of grinding surfaces of a workpiece by immersing the workpiece in a processing solution with abrasive grains suspended therein and radiating ultrasonic energy into the processing solution. As a result, the inventor has found that while a processing solution supplied to an ultrasonic processing tank is deaerated by ultrasonic energy radiated from an ultrasonic vibrator, if the processing solution is left as it is, the amount of a gas dissolved in the processing solution increases because of air dissolved into the processing solution from its surface. As the amount of a dissolved gas increases, the dissolved gas tends to vaporize into bubbles in the cavitation developed by the ultrasonic energy. The bubbles make it difficult for shock waves to be produced, or absorb and reduce the intensity of generated shock waves.

The inventor has also found that the processing solution in the ultrasonic processing tank is heated by absorbing the ultrasonic energy radiated from the ultrasonic vibrator. When the processing solution is heated, the dissolved gas has a greater tendency to vaporize into bubbles in the cavitation developed by the ultrasonic energy, making it difficult for shock waves to be produced, or absorbing and reducing the intensity of generated shock waves.

According to an aspect of the present invention, there is provided a method of ultrasonically grinding a workpiece, comprising the steps of immersing a workpiece in a processing solution with abrasive grains suspended therein, the processing solution being contained in an ultrasonic processing tank equipped with an ultrasonic vibrator, radiating ultrasonic energy from the ultrasonic vibrator into the processing solution to grind surfaces of the workpiece, cooling the processing solution to a temperature lower than a boiling point thereof, and deaerating the processing solution.

Since the processing solution is cooled and deaerated, cavitation is more likely to be developed by the radiated ultrasonic energy. Shock waves generated when the cavitation collapses are applied to the workpiece immersed in the processing solution and also to the abrasive grains suspended in the processing solution.

Therefore, the surfaces of the workpiece are exposed to the shock waves and also hit by the abrasive grains that are being subjected to the shock waves. Burrs on the workpiece are now removed, and relatively large surface irregularities on the workpiece are smoothed out.

The abrasive grains may comprise a grinding material of particles having an average diameter ranging from 0.1 to 70 μm. The abrasive grains are difficult to produce with an average diameter below 0.1 μm. If the average diameter of the abrasive grains exceeded 70 μm, they would easily settle down, tending to grind and damage the bottom of the ultrasonic processing tank. The abrasive grains may be primarily composed of alumina, silicon carbide, or the like, and may have a particle size according to #240~#8000 under R6001 of JIS.

The processing solution may be deaerated to an oxygen content ranging from 0.5 to 3 ppm for easy cavitation in the processing solution. Air is dissolved in the processing solution. However, since the composition of gases in the air is substantially constant, the amount of dissolved oxygen is used as an indication of the amount of a dissolved gas. It is known that water at normal temperature contains about 8 ppm of saturated oxygen dissolved therein.

The processing solution can easily be heated to a temperature range from 40° to 60° C. when the ultrasonic energy is radiated into the processing solution. The processing solution should therefore be cooled to a temperature ranging from 10 to 30° C. In the processing solution thus cooled, the dissolved gas is less liable to vaporize in the cavitation, and intensive shock waves are produced when the cavitation collapses.

The ultrasonic vibrator may be mounted on the bottom of the ultrasonic processing tank. Inasmuch as the ultrasonic vibrator on the bottom of the ultrasonic processing tank can radiate ultrasonic energy in a wide range in the processing solution, the method is suitable for grinding a workpiece having a substantially flat surface configuration or preliminarily cleaning a workpiece having a complex surface profile. For example, the method is effective to remove small burrs from lapped razor blades, remove mill scales from iron plates, and grind inner and outer surfaces of quartz glass tubes.

The ultrasonic vibrator may comprise a rod-shaped ultrasonic vibratory member having a tip end immersed in the processing solution for radiating the ultrasonic energy into the processing solution. This arrangement permits the ultrasonic energy to concentrate in a certain range in the processing solution. The method is suitable for grinding a workpiece having a partial burred region or a workpiece having a complex surface profile, or for cleaning a workpiece after it has preliminarily been cleaned. Such a workpiece with a partial burred region or a workpiece having a fragile region which would be damaged by the application of ultrasonic energy may for example be an aluminum die casting.

The processing solution may be circulated to reduce the amount of waste processing solution. To use the processing solution in circulation, it is preferable to draw the processing solution from the ultrasonic processing tank, and circulate the processing solution to the ultrasonic processing tank after the processing solution has been cooled and deaerated. The processing solution drawn from the ultrasonic processing tank contains foreign matter removed from the workpiece as it is ground, it is preferable to filter the processing solution before the processing solution is circulated to the ultrasonic processing tank to prevent a cooling or deaerating device from being damaged by the foreign matter.

According to another aspect of the present invention, there is provided a method of ultrasonically grinding a workpiece, comprising the steps of immersing a workpiece and an electrode as an anode and a cathode, respectively, in an electrolytic processing solution, the electrolytic solution being contained in an ultrasonic processing tank equipped with an ultrasonic vibrator, applying a voltage between the workpiece and the electrode, simultaneously radiating ultrasonic energy from the ultrasonic vibrator into the electrolytic solution to electrolytically grind surfaces of the workpiece, drawing the electrolytic solution from the ultrasonic processing tank, cooling the electrolytic solution to a temperature lower than a boiling point thereof, deaerating the electrolytic solution, and thereafter circulating the electrolytic solution to the ultrasonic processing tank.

Since the electrolytic solution is cooled and deaerated, cavitation is more likely to be developed by the radiated ultrasonic energy. Shock waves generated when the cavitation collapses are applied to the workpiece immersed in the electrolytic solution. Therefore, oxygen bubbles attached to the workpiece surfaces upon electrolysis are removed, allowing the workpiece surfaces to contact the electrolytic solution for thereby accelerating the electrolysis.

Inasmuch as the electrolytic solution is circulated in use, even if the oxygen bubbles removed from the workpiece bubbles are dissolved in the electrolytic solution, the electrolytic solution is deaerated during circulation. The amount of a gas dissolved in the electrolytic solution in the ultrasonic processing tank is thus prevented from increasing.

The electrolytic solution may be deaerated to an oxygen content ranging from 0.5 to 3 ppm for easy cavitation in the processing solution. The electrolytic solution may be cooled to a temperature ranging from 10° to 30° C. for producing intensive shock waves upon collapse of the cavitation.

The ultrasonic vibrator should preferably be positioned for radiating the ultrasonic energy in a wide range in the electrolytic solution to remove oxygen bubbles from the workpiece surfaces to bring the workpiece surfaces into contact with the electrolytic solution. To this end, the ultrasonic vibrator should preferably be mounted on the bottom of the ultrasonic processing tank.

To remove foreign matter that has mixed into the electrolytic solution from the workpiece surfaces by the shock waves upon collapse of the cavitation, the electrolytic solution should preferably be filtered before the electrolytic solution is circulated to the ultrasonic processing tank.

If a workpiece has many burrs, then it takes a long period of time to remove these burrs by way of the electrolytic grinding process. To grind such a workpiece, abrasive grains should preferably be suspended in the electrolytic solution in the ultrasonic processing tank. The abrasive grains are effective to remove the burrs and form surface irregularities of a size suitable for the electrolytic grinding process. Accordingly, the electrolysis is further accelerated.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
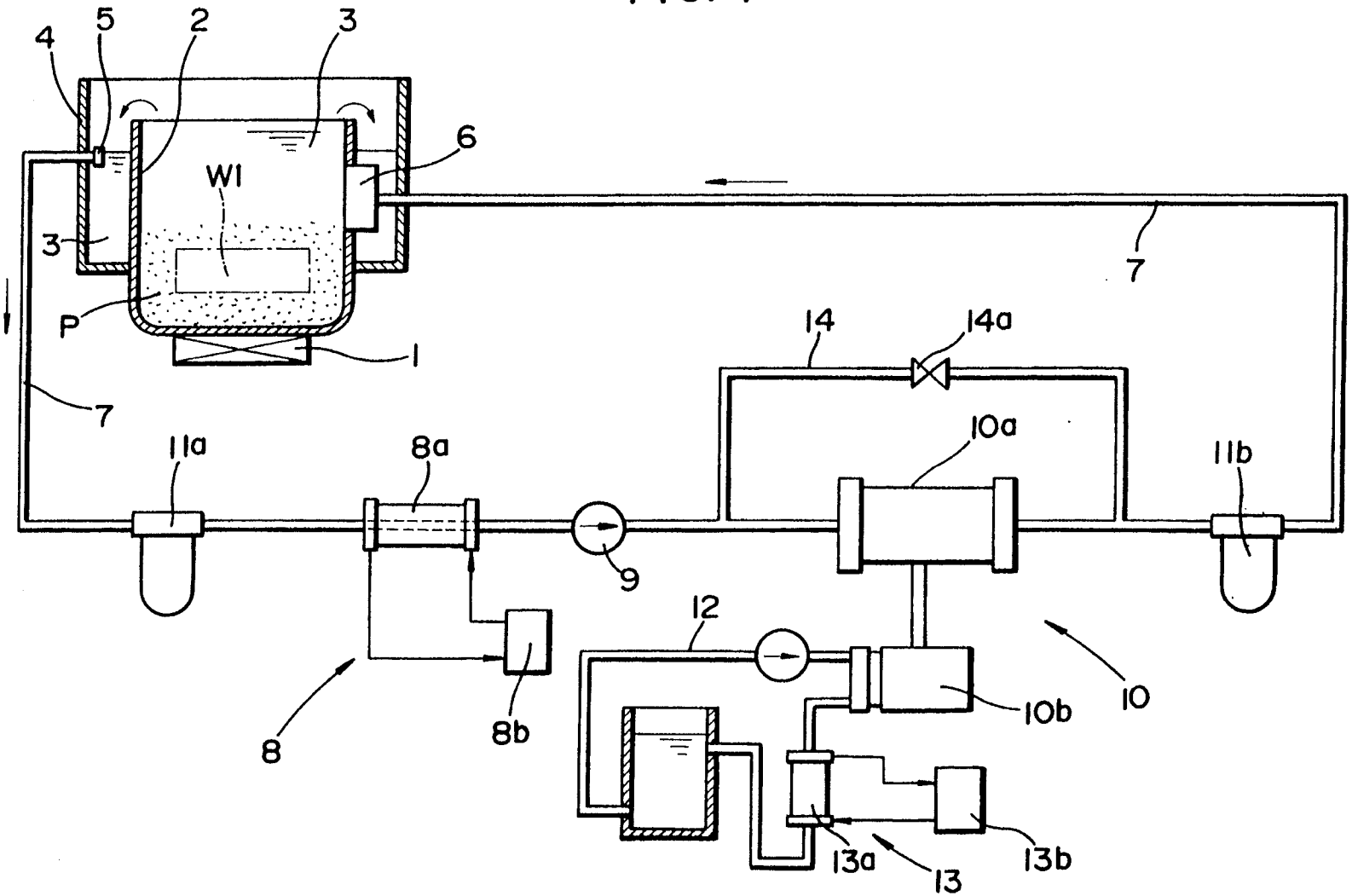
FIG. 1 is a schematic diagram of an ultrasonic processing system for carrying out a method of ultrasonically grinding a workpiece according to a first embodiment of the present invention.

An ultrasonic processing system shown in FIG. 1 for carrying out a method of ultrasonically grinding a workpiece according to a first embodiment of the present invention has an ultrasonic processing tank 2 with an ultrasonic vibrator 1 mounted on the outer surface of its bottom. The ultrasonic processing tank 2 is supplied with a processing liquid or water 3 in which abrasive grains P are suspended. The ultrasonic processing tank 2 is surrounded by an overflow tank 4 for storing the processing water 3 that has overflowed the ultrasonic processing tank 2. The processing water 3 circulates from an outlet 5 on a side wall of the overflow tank 4 to an inlet 6 on a side wall of the ultrasonic processing tank 2 through a circulation conduit 7. The circulation conduit 7 is connected to a cooling device 8, a circulation pump 9, and a deaerating device 10, and has a filter 11*a* positioned upstream of the cooling device 8 and a filter 11*b* positioned downstream of the deaerating device 10.

The inlet 6 has a flow-rectifying device for smoothing the flow of processing water 3 supplied from the circulation conduit 7 into the ultrasonic processing tank 2 so that no disturbance will be developed in the processing water 3 in the ultrasonic processing tank 2 by the supplied flow of processing water 3.

The circulation conduit 7 is in the form of a transparent pipe of vinyl resin or the like. Since the circulation conduit 7 is transparent, any damage caused thereto by abrasive grains P that may be introduced from the ultrasonic processing tank 2 through the overflow tank 4 can readily be spotted for repair or replacement.

The cooling device 8 comprises a cooling unit 8*a* disposed around the circulation conduit 7 and supplied with a coolant such as cooling water, and a cooling machine 8*b* for cooling the coolant. The coolant cooled by the cooling machine 8*b* is circulated through the cooling unit 8*a* to cool the processing water 3 that flows through the circulation conduit 7 in the cooling unit 8*a* by way of a heat exchange between the coolant and the processing water 3. In the cooling unit 8*a*, the coolant flows in a direction opposite to the direction in which the processing water 3 flows through the circulation conduit 7 for an increased heat exchange efficiency.

The deaerating device 10 comprises a module 10*a* of hollow fibrous gas separation membranes connected to the circulation conduit 7 and a water-sealed vacuum pump 10*b* coupled to the module 10*a* for developing a vacuum around the hollow fibrous gas separation membranes. When the pressure around the hollow fibrous gas separation membranes is reduced by the water-sealed vacuum pump 10*b*, a gas dissolved in the processing water 3 flowing through the hollow fibrous gas separation membranes is removed through the walls thereof, for thereby deaerating the processing water 3.

The vacuum pump 10*b* is sealed by sealing water supplied from a conduit 12. Since the sealing water circulates through the conduit 12, the amount of any waste sealing water is minimum. When the sealing water circulates in use, however, its temperature gradually rises, reducing the efficiency with which to reduce the pressure around the hollow fibrous gas separation membranes. To avoid this drawback, the conduit 12 is connected to a sealing water cooling device 13 which cools the sealing water to increase the efficiency with which to reduce the pressure around the hollow fibrous gas separation membranes.

The sealing water cooling device 13 is essentially the same as the cooling device 8, and comprises a cooling unit 13*a* and a cooling machine 13*b*. A coolant such as cooling water cooled by the cooling machine 13*b* circulates through the cooling unit 13*a* to cool the sealing water that flows through the conduit 12 which extends in the cooling unit 13*a*.

The deaerating device 10 is bypassed by a bypass conduit 14 connected to the circulation conduit 7 across the module 10*a*. The bypass conduit 14 has a flow regulating valve 14*a* for regulating the rate at which the processing water 3 is supplied to the module 10*a*.

The filters 11*a*, 11*b* serve to filter out small particles of foreign matter produced by ultrasonic grinding which is mixed in the processing water 3 that flows out of the ultrasonic processing tank 2. The filter 11*a* removes small particles of foreign matter contained in the processing water 3 thereby to protect the cooling device 8, the circulation pump 9, and the deaerating device 10, which are positioned downstream of the filter 11*a*, from damage. The filter 11*b* removes smaller particles of foreign matter that have passed through the filter 11*a* to protect the portion of the circulation conduit 7 downstream of the filter 11*b* from damage. Therefore, the processing water 3 free from the particles of foreign matter flows back to the ultrasonic processing tank 2.

In operation, the processing water 3 that has overflowed from the ultrasonic processing tank 2 into the overflow tank 4 is supplied from the outlet 5 through the circulation conduit 7 to the cooling device 8 by the circulation pump 9, and cooled to a temperature ranging from 10° to 30° C. by the cooling device 8.

The processing solution can easily be heated to a temperature range from 40° to 60° C. when the ultrasonic energy is radiated into the processing solution. The processing solution should therefore be cooled to a temperature ranging from 10° to 30° C. In the processing solution thus cooled, the dissolved gas is less liable to vaporize in the cavitation, and intensive shock waves are produced when the cavitation collapses.

Before the processing water 3 is supplied to the cooling device 8, small particles of foreign matter are removed from the processing water 3 by the filter 11*a*. The cooled processing water 3 is then fed to the deaerating device 10 which deaerates the processing water 3 such that the amount of a dissolved gas in the processing water 3, as expressed by the amount of dissolved oxygen, is reduced to 2 ppm.

The processing solution may be deaerated to an oxygen content ranging from 0.5 to 3 ppm for easy cavitation in the processing solution. Air is dissolved in the processing solution. However, since the composition of gases in the air is substantially constant, the amount of dissolved oxygen is used as an indication of the amount of a dissolved gas. It is known that water at normal temperature contains about 8 ppm of saturated oxygen dissolved therein.

Thereafter, smaller particles of foreign matter which have passed through the filter 10*a* are removed from the processing water 3 by the filter 11*b*. The processing water 3 then returns from the inlet 6 into the ultrasonic processing tank 2.

In the ultrasonic processing tank 2, therefore, the abrasive grains P are suspended in the processing water 3 that has been cooled to the above temperature range by the cooling device 8 and deaerated to the above oxygen content by the deaerating device 10. A workpiece W1 which is substantially in the form of a flat plate is immersed in the processing water 3, and then ultrasonic energy is radiated from the ultrasonic vibrator 1 into the processing water 3 to grind the surfaces of the workpiece W1. The workpiece W1 may for example be a razor blade with a burr having a height of about 100 μm on a lapped surface.

The abrasive grains P for grinding the workpiece W1 are of a grinding material of fine particles primarily composed of green silicon carbide. In this embodiment, the abrasive grains P are defined according to #4000~#6000 (average particle size or diameter of about 1.2~3 μm) under R6001 of JIS, and 10 to 300 g of such abrasive grains P are suspended per liter of the processing water 3 in the ultrasonic processing tank 2.

The abrasive grains may comprise a grinding material of particles having an average diameter ranging from 0.1 to 70 μm. The abrasive grains are difficult to produce with an average diameter below 0.1 μm. If the average diameter of the abrasive grains exceeded 70 μm, they would easily settle down, tending to grind and damage the bottom of the ultrasonic processing tank. The abrasive grains may be primarily composed of alumina, silicon carbide, or the like, and may have a particle size according to #240~#8000 under R6001 of JIS. The average diameter of the abrasive grains may be selected from the above range. Since the abrasive grains are liable to be suspended in the processing solution, the abrasive grains should preferably be primarily composed of green silicon carbide, and have a particle size of #2000~#8000, especially, #4000~#8000 under R6001 of JIS.

The provision R6001 of JIS defines the particle sizes of artificial grinding materials and other general grinding materials. The particle size range from #8~#220 is defined as coarse grain, and the particle size range from #240~#8000 as abrasive powder. The particle size of coarse grain is determined by a sieve analysis which measures the amount of coarse grain that has passed through a standard sieve of certain mesh size. The particle size of abrasive powder is determined by a settling analysis or an electric resistance analysis.

Figure 6:
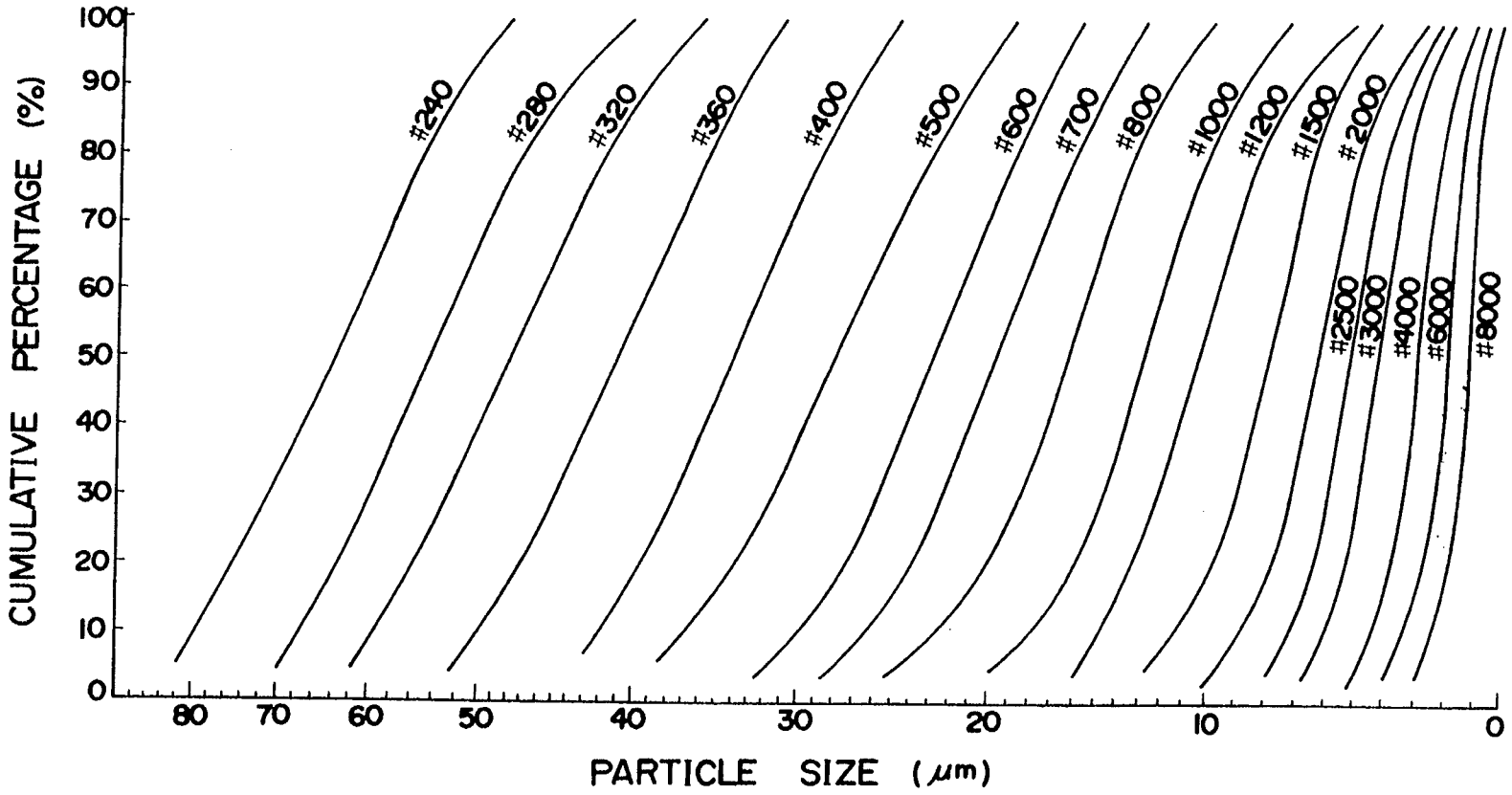
FIG. 6 is a graph showing a particle size distribution of abrasive grains according to the provision of R6001 of Japan Industrial Standard (JIS).

FIG. 6 shows a particle size distribution of abrasive powder in a particle size range from #240~#8000. To obtain the data shown in FIG. 6, abrasive materials are settled in order from larger particle sizes, and the weight of an abrasive material having particle sizes in a certain range is measured, and counted in that range. Accumulated counts indicative of measured weights higher than a certain value are converted into a cumulative percentage. The graph of FIG. 6 has a horizontal axis representing the particle size and a vertical axis representing the cumulative percentage. For example, the abrasive material indicated by #400 has a particle size distribution such that it contains 50 weight % or more of abrasive powder having a particle size of 30±2 μm or more and 94 weight % or more of abrasive powder having a particle size of 20 μm.

Figure 2:
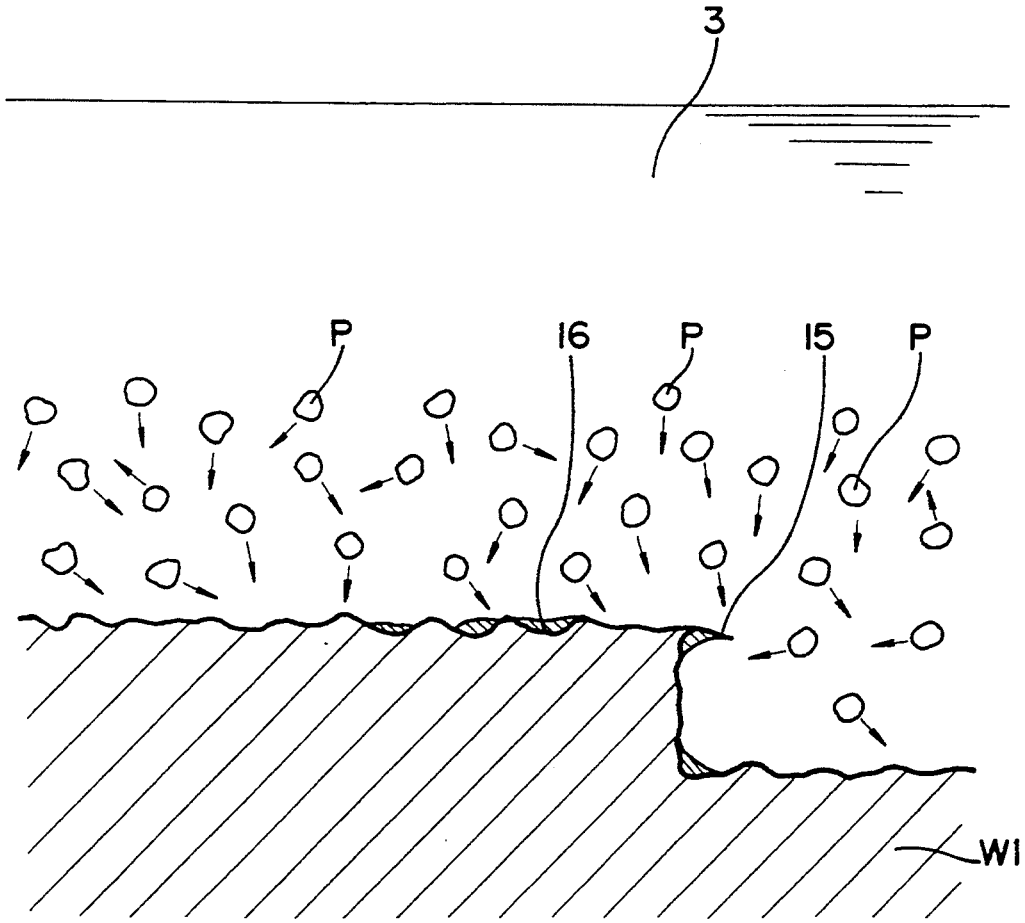
FIG. 2 is a schematic diagram illustrative of the action of abrasive grains in the method.

Since the processing water 3 has been cooled and deaerated, violent cavitation is developed in the processing water 3 by the radiated ultrasonic energy, and shock waves produced when the cavitation collapses are applied to the suspended abrasive grains P, which are brought into collision with the surfaces of the workpiece W1 for thereby removing a burr 15 on a lapped surface region of the workpiece W1, as shown in FIG. 2. The abrasive grains P also collide with relatively large surface irregularities 16 on the workpiece W1, thus reducing the size of such relatively large surface irregularities 16. As a consequence, the burr 15 is removed and the surface irregularities 16 are smoothed out. In this manner, the surfaces of the workpiece W1 are ground.

Since the surfaces of the workpiece W1 are exposed to the shock waves, foreign matter attached to the workpiece W1 is removed thereby. Therefore, the surfaces of the workpiece W1 are cleaned as well as ground.

When the ultrasonic energy is radiated from the ultrasonic vibrator 1 into the processing water 1 in the ultrasonic processing tank 2, the processing water 1 is heated by the radiated ultrasonic energy. While the processing water 3 is being deaerated by the ultrasonic energy, the amount of a dissolved gas is increased by air that is dissolved into the processing water 3 from its surface. In this embodiment, as the processing water 3 overflows from the ultrasonic processing tank 2 into the overflow tank 4 and circulates through the circulation conduit 7, the processing water 3 is cooled to the above temperature range by the cooling device 8, and deaerated to the above oxygen content by the deaerating device 10. Consequently, the processing water 3 which is kept cooled and deaerated at all times is supplied to the ultrasonic processing tank 2. The ultrasonic energy radiated by the ultrasonic vibrator 1 is highly effective to develop cavitation in the processing water 3 in the ultrasonic processing tank 2, and intensive shock waves are generated when the cavitation collapses.

Figure 3:
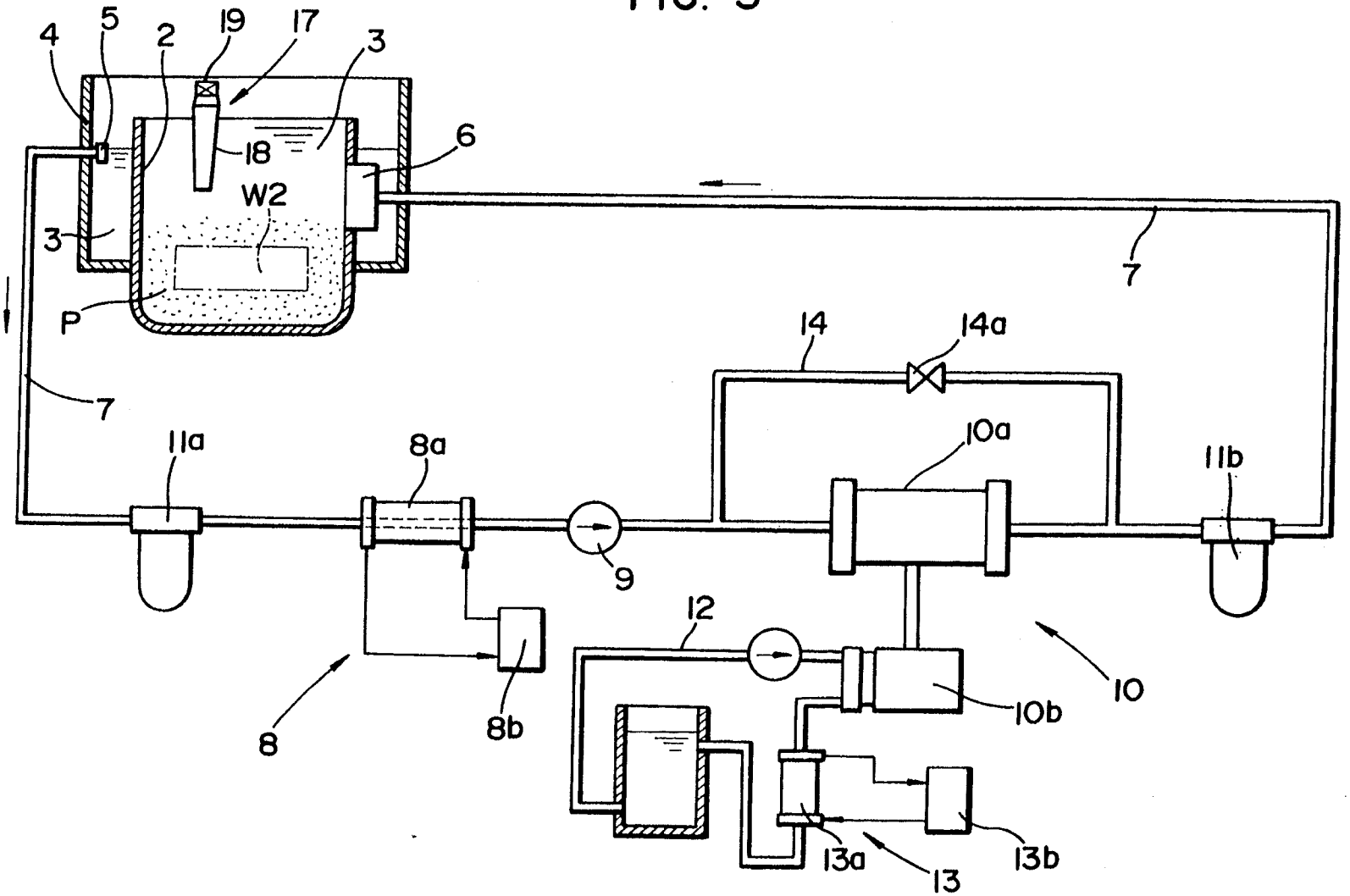
FIG. 3 is a schematic diagram of an ultrasonic processing system for carrying out a method of ultrasonically grinding a workpiece according to a second embodiment of the present invention.

FIG. 3 shows an ultrasonic processing system for carrying out a method of ultrasonically grinding a workpiece according to a second embodiment of the present invention. The ultrasonic processing system shown in FIG. 3 is essentially the same as the ultrasonic processing system shown in FIG. 1 except that a lower end portion of a rod-shaped ultrasonic vibrator 17 is immersed in the processing water 3 in the ultrasonic processing tank 2. The ultrasonic vibrator 17 comprises a metallic vibratory member 18 tapered toward its lower tip end and a piezoelectric element 19 threaded in the opposite end of the vibratory member 18. The ultrasonic vibrator 17 radiates ultrasonic energy from the tapered tip end of the vibratory member 18.

The ultrasonic processing tank 2 is supplied from the inlet 6 with the processing water 3 that has been cooled to a temperature range from 10° to 30° C. by the cooling device 8, and deaerated to an oxygen content of 2 ppm by the deaerating device 10.

The abrasive grains P are suspended in the processing water 3 cooled to the above temperature range and deaerated to the above oxygen content. A workpiece W2 in the form of an aluminum die casting is immersed in the processing water 3, and the ultrasonic vibrator 17 immersed in the processing water 3 is directed toward a burred region of the workpiece W2. Then, ultrasonic energy is radiated from the tip end of the ultrasonic vibrator 17 into the processing water 3 to grind the surfaces of the workpiece W2.

Cavitation is violently developed by the radiated ultrasonic energy in the processing water 3 between the tip end of the ultrasonic vibrator 17 and the burred region of the workpiece W2. Shock waves that are produced when the cavitation collapses are directly applied to the burred region of the workpiece W2, and also to the abrasive grains P suspended in the processing water 3. The abrasive grains P collide with the surface region of the workpiece W2 to which the tip end of the ultrasonic vibrator 17 is directed, removing burrs from the workpiece W2. The workpiece W2 is thus ground.

At the same time, inasmuch as the surfaces of the workpiece W2 are exposed to the shock waves, foreign matter attached to the workpiece W2 is removed by the applied shock waves. Accordingly, the workpiece W2 is cleaned as well as ground.

According to the method of the second embodiment, only the burred region of the workpiece W2 to which the tip end of the ultrasonic vibrator 17 is directed is intensively exposed to the shock waves and hit by the abrasive grains P, so that burrs can efficiently be removed from the workpiece W2. As no ultrasonic energy is applied to those surface regions of the workpiece W2 to which the tip end of the ultrasonic vibrator 17 is not directed, they are not damaged by the shock waves even if they are made of a fragile material.

In this embodiment, the abrasive grains P for grinding the workpiece W2 are of a grinding material of fine particles primarily composed of green silicon carbide. The abrasive grains P are have a particle size according to #4000~#6000 (average particle size or diameter of about 1.2~3 μm) under R6001 of JIS, and 10 to 300 g of such abrasive grains P are suspended per liter of the processing water 3 in the ultrasonic processing tank 2.

If the workpiece W2 has a complex surface configuration, then the workpiece W2 may be cleaned by moving the ultrasonic vibrator 17 along the surface configuration of the workpiece W2. The method according to the second embodiment may be used to grind and clean those surface regions of the workpiece W1 which still have foreign matter and burrs after the workpiece W1 has been ground and cleaned by the ultrasonic processing system shown in FIG. 1.

Figure 4:
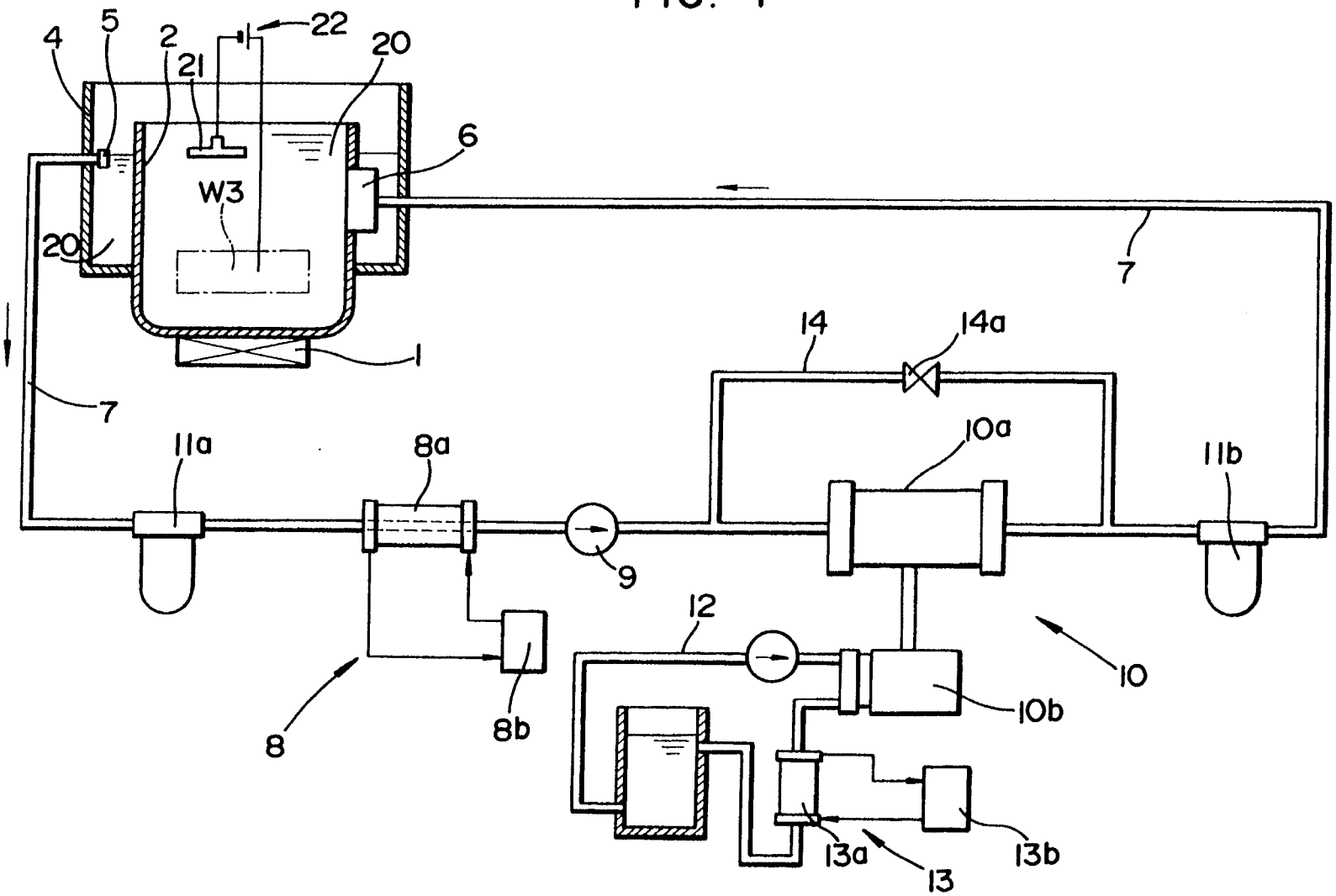
FIG. 4 is a schematic diagram of an ultrasonic processing system for carrying out a method of ultrasonically grinding a workpiece according to a third embodiment of the present invention.

FIG. 4 shows an ultrasonic processing system for carrying out a method of ultrasonically grinding a workpiece according to a third embodiment of the present invention. The ultrasonic processing system shown in FIG. 4 is essentially the same as the ultrasonic processing system shown in FIG. 1 except that the ultrasonic processing tank 2 is supplied with an electrolytic solution 20 with no abrasive grains suspended, rather than the processing water 3, and a workpiece W3 in the form of an aluminum die casting and an electrode 21 are immersed as an anode and a cathode, respectively, in the electrolytic solution 20, the workpiece W3 and the electrode 21 being electrically connected to an external power supply 22. The electrolytic solution 20 comprises a solution which is a mixture of 800 ml of phosphoric acid ($H_3PO_4$) and 200 ml of sulfuric acid, and 30 g or less of chrome oxide dissolved in the solution.

The electrolytic solution 20 is cooled to a temperature range from 10° to 30° C. by the cooling device 8, and deaerated to an oxygen content of 2 ppm by the deaerating device 10. The electrolytic solution 20 thus cooled and deaerated is supplied from the inlet 6 into the ultrasonic processing tank 2.

The workpiece W3 and the electrode 21 are immersed in the electrolytic solution 20 that has been cooled to the above temperature range and deaerated to the above oxygen content. A voltage ranging from 6 to 48 V is applied between the workpiece W3 and the electrode 21, and at the same time ultrasonic energy is radiated from the ultrasonic vibrator 1 into the electrolytic solution 20 to electrolytically grind the surfaces of the workpiece W3.

Since the electrolytic solution 20 has been cooled and deaerated as described above, violent cavitation is developed in the electrolytic solution 20 by the radiated ultrasonic energy. Shock waves produced when the cavitation collapses remove oxygen bubbles that are attached to the surfaces of the workpiece W3 when they are dissolved by the electrolytic process, thereby allowing the surfaces of the workpiece W3 to contact the electrolytic solution 20 for accelerating the electrolysis.

Inasmuch as the surfaces of the workpiece W3 are exposed to the shock waves, foreign matter attached to the workpiece W3 is removed thereby. Accordingly, the surfaces of the workpiece W3 are cleaned as well as electrolytically ground.

When the ultrasonic energy is radiated from the ultrasonic vibrator 1 into the electrolytic solution 20 in the ultrasonic processing tank 2, the electrolytic solution 20 is heated by the radiated ultrasonic energy, and the amount of a dissolved gas therein increases. In this embodiment, as the electrolytic solution 20 overflows from the ultrasonic processing tank 2 into the overflow tank 4 and circulates through the circulation conduit 7, the electrolytic solution 20 is cooled to the above temperature range by the cooling device 8, and deaerated to the above oxygen content by the deaerating device 10. Consequently, the electrolytic solution 20 which is kept cooled and deaerated at all times is supplied to the ultrasonic processing tank 2. The ultrasonic energy radiated by the ultrasonic vibrator 1 is highly effective to develop cavitation in the electrolytic solution 20 in the ultrasonic processing tank 2, and intensive shock waves are generated when the cavitation collapses.

Figure 5:
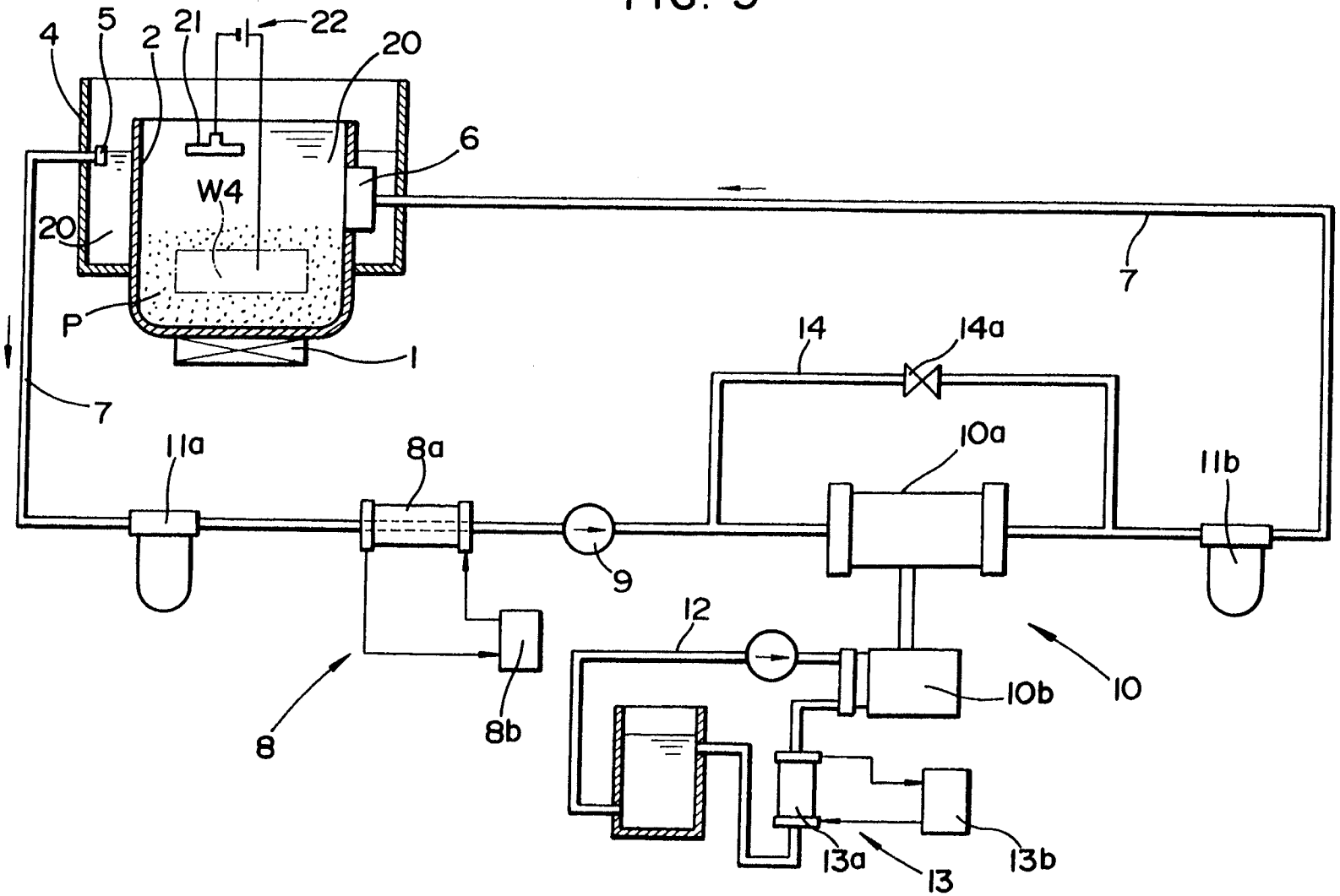
FIG. 5 is a schematic diagram of an ultrasonic processing system for carrying out a method of ultrasonically grinding a workpiece according to a fourth embodiment of the present invention.

FIG. 5 shows an ultrasonic processing system for carrying out a method of ultrasonically grinding a workpiece according to a fourth embodiment of the present invention. The ultrasonic processing system shown in FIG. 5 is essentially the same as the ultrasonic processing system shown in FIG. 4 except that abrasive grains P are suspended in the electrolytic solution 20 and a workpiece W4 in the form of an aluminum die casting is immersed in the electrolytic solution 20. The workpiece W4 has more burrs on its surfaces than the workpiece W3 shown in FIG. 4, and will be electrolytically ground for a long period of time.

In the ultrasonic processing system shown in FIG. 5, the electrolytic solution 20 is cooled to a temperature range from 10° to 30° C. by the cooling device 8, and deaerated to an oxygen content of 2 ppm by the deaerating device 10. The electrolytic solution 20 thus cooled and deaerated is supplied from the inlet 6 into the ultrasonic processing tank 2.

The workpiece W4 and the electrode 21 are immersed in the electrolytic solution 20 that has been cooled to the above temperature range and deaerated to the above oxygen content. A voltage ranging from 6 to 48 V is applied between the workpiece W4 and the electrode 21, and at the same time ultrasonic energy is radiated from the ultrasonic vibrator 1 into the electrolytic solution 20 to electrolytically grind the surfaces of the workpiece W4.

Since the electrolytic solution 20 has been cooled and deaerated as described above, violent cavitation is developed in the electrolytic solution 20 by the radiated ultrasonic energy. Shock waves produced when the cavitation collapses are applied to the abrasive grains P suspended in the electrolytic solution 20, causing the abrasive grains P to collide with the surface of the workpiece W4. Burrs on the surfaces of the workpiece W4 are therefore removed, forming surface irregularities of a size suitable to be electrolytically ground. Since the shock waves are also directly applied to the surfaces of the workpiece W4, they remove oxygen bubbles that are attached to the surfaces of the workpiece W3, thereby allowing the surfaces of the workpiece W4 to contact the electrolytic solution 20 for accelerating the electrolysis to grind the workpiece surfaces in a short period of time.

Inasmuch as the surfaces of the workpiece W4 are exposed to the shock waves, foreign matter attached to the workpiece W4 is removed thereby. Accordingly, the surfaces of the workpiece W4 are cleaned as well as electrolytically ground.

In this embodiment, the abrasive grains P for grinding the workpiece W4 are of a grinding material of fine particles primarily composed of green silicon carbide. The abrasive grains P are defined according to #4000~#6000 (average particle size or diameter of about 1.2~3 μm) under R6001 of JIS, and 10 to 300 g of such abrasive grains P are suspended per liter of the electrolytic solution 20 in the ultrasonic processing tank 2.

Although certain preferred embodiments of the present invention have been shown and described in detail, it should be understood that various changes and modifications may be made therein without departing from the scope of the appended claims.

What is claimed is:

1. A method of ultrasonically grinding a workpiece, comprising the steps of:

immersing a workpiece and an electrode as an anode and a cathode, respectively, in an electrolytic processing solution, the electrolytic solution being contained in an ultrasonic processing tank equipped with an ultrasonic vibrator;

applying a voltage between said workpiece and said electrode;

simultaneously radiating ultrasonic energy from said ultrasonic vibrator into said electrolytic solution to electrolytically grind surfaces of the workpiece;

drawing the electrolytic solution from said ultrasonic processing tank;

cooling the electrolytic solution to a temperature lower than a boiling point thereof;

deaerating the electrolytic solution; and thereafter circulating and returning the electrolytic solution to said ultrasonic processing tank.

2. A method according to claim 1, wherein said electrolytic solution is deaerated to an oxygen content ranging from 0.5 to 3 ppm.

3. A method according to claim 1, wherein said electrolytic solution is cooled to a temperature ranging from 10° to 30° C.

4. A method according to claim 1, wherein said ultrasonic vibrator is mounted on the bottom of said ultrasonic processing tank.

5. A method according to claim 1, further comprising the step of:

filtering the electrolytic solution before the electrolytic solution is returned to said ultrasonic processing tank.

6. A method according to claim 1, wherein abrasive grains are suspended in said electrolytic solution in the ultrasonic processing tank.

7. A method according to claim 1, further comprising circulating said electrolytic solution through a substantially transparent conduit, said conduit connected to a fluid outlet through which the electrolytic solution is drawn from said ultrasonic processing tank and connected to a fluid inlet through which said electrolytic solution is returned to said ultrasonic processing tank after having circulated through said conduit.

8. A method according to claim 1, further comprising the step of:

circulating said electrolytic,solution through a conduit, said conduit connected to a fluid outlet through which the electrolytic solution is drawn from said ultrasonic processing tank and connected to a fluid inlet through which said electrolytic solution is returned to said ultrasonic processing tank after having circulated through said conduit; and wherein said electrolytic solution is cooled by circulating a cooling fluid through a cooling jacket disposed around said conduit, said cooling fluid flowing in a direction opposite to a direction in which the electrolytic solution is circulated through said conduit.

9. A method according to claim 1, wherein said step of deaerating said electrolytic solution further comprises the steps of:

passing said electrolytic solution through a plurality of hollow fibrous gas separating membranes; and developing a vacuum around said gas separating membranes with a vacuum pump to deaerate said electrolytic solution.

10. A method according to claim 9, wherein said vacuum pump is sealed by sealing water supplied through a conduit to said vacuum pump, and further Comprising the step of cooling said sealing water, wherein said sealing water is cooled by circulating a cooling fluid through a cooling jacket disposed around said conduit.

* * * * *